US009481992B2

(12) United States Patent
Stammel et al.

(10) Patent No.: US 9,481,992 B2
(45) Date of Patent: Nov. 1, 2016

(54) FREESTANDING TOILET WITH CAST-ON TOILET TANK

(71) Applicant: DURAVIT AKTIENGESELLSCHAFT, Hornberg (DE)

(72) Inventors: Thomas Stammel, Hornberg (DE); Juan De La Corte, Haslach (DE); Emil Vuck, Hornberg (DE); Werner Griebe, Weinboehla (DE)

(73) Assignee: DURAVIT AKTIENGESELLSCHAFT, Hornberg (DE)

( * ) Notice: Subject to any disclaimer, the term of this patent is extended or adjusted under 35 U.S.C. 154(b) by 295 days.

(21) Appl. No.: 13/891,348

(22) Filed: May 10, 2013

(65) Prior Publication Data

US 2013/0305445 A1 Nov. 21, 2013

(30) Foreign Application Priority Data

May 18, 2012 (DE) ..... 10 2012 010 580

(51) Int. Cl.

| | |
|---|---|
| ***E03D 11/13*** | (2006.01) |
| ***E03D 1/28*** | (2006.01) |
| ***E03D 11/02*** | (2006.01) |
| ***E03D 11/06*** | (2006.01) |
| ***B28B 1/00*** | (2006.01) |
| *B28B 1/26* | (2006.01) |

(52) U.S. Cl.

CPC ..... *E03D 11/13* (2013.01); *B28B 1/002* (2013.01); *E03D 1/286* (2013.01); *E03D 11/02* (2013.01); *E03D 11/06* (2013.01); *B28B 1/26* (2013.01)

(58) Field of Classification Search

CPC ..... E03D 1/28; E03D 11/13; E03D 1/286; E03D 2201/30

USPC ..... 4/425

See application file for complete search history.

(56) References Cited

U.S. PATENT DOCUMENTS

| | | | | |
|---|---|---|---|---|
| 1,142,249 | A * | 6/1915 | Griffiths | E03D 11/13 4/420 |
| 3,405,203 | A | 10/1968 | Derror | |
| 4,982,454 | A | 1/1991 | Saltel et al. | |

(Continued)

FOREIGN PATENT DOCUMENTS

| | | |
|---|---|---|
| AT | 403302 B | 1/1998 |
| CN | 101851953 A | 10/2010 |

(Continued)

OTHER PUBLICATIONS

European Search Report dated Mar. 13, 2015 for corresponding Patent Application 13165492.3.

(Continued)

*Primary Examiner* — Janie Loeppke

(74) *Attorney, Agent, or Firm* — Lucas & Mercanti, LLP

(57) ABSTRACT

Free-standing toilet with cast-on toilet tank, comprising a ceramic toilet body and a ceramic toilet tank, wherein the pressure cast toilet body (2) has an annular flange (11) located on the upper rim of its bowl section (10), which annular flange continues circumferentially around and extends substantially horizontally toward the inside of the bowl section (10) and serves as a border for flushing water that is introduced below the annular flange (11) by means of an introduction unit (14), and in that the toilet tank (3), which is also pressure cast, is fixedly joined to the toilet body (2) by means of a ceramic bonding.

7 Claims, 5 Drawing Sheets

(56) References Cited

U.S. PATENT DOCUMENTS

Figure 1:
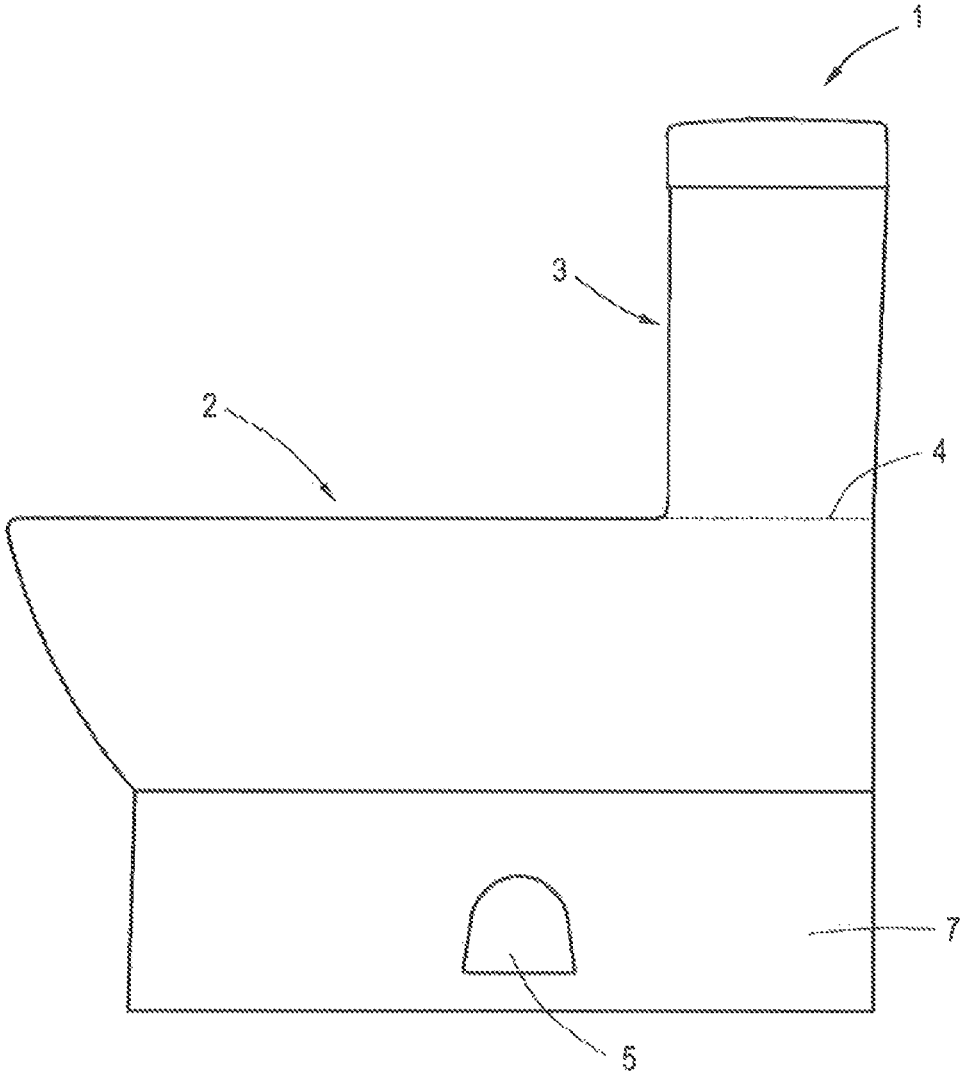

| | | | | |
|---|---|---|---|---|
| 6,470,505 | B1 * | 10/2002 | Boisvert | E03D 3/10 4/322 |
| 6,779,996 | B2 | 8/2004 | Bergquist et al. | |
| 2003/0088910 | A1 * | 5/2003 | Hidetaka et al. | 4/425 |
| 2006/0005310 | A1 | 1/2006 | Nakamura et al. | |

FOREIGN PATENT DOCUMENTS

| | | | | | |
|---|---|---|---|---|---|
| CN | 102261114 | A | | 11/2011 | |
| DE | 10132790 | A1 | | 1/2003 | |
| EP | 0689912 | A1 | | 1/1998 | |
| GB | 507908 | | | 6/1939 | |
| GB | 2431937 | A | * | 5/2007 | E03D 11/06 |
| JP | 3067609 | A | | 3/1991 | |
| JP | 2004306594 | A | | 11/2004 | |

OTHER PUBLICATIONS

English Translation of Chinese Office Action.

* cited by examiner

FREESTANDING TOILET WITH CAST-ON TOILET TANK

CROSS-REFERENCE TO RELATED APPLICATIONS

This application claims the priority of DE 10 2012 010 580.0 flied May 18, 2012, which is incorporated by reference herein.

The invention relates to a free-standing toilet with a cast-on toilet tank, comprising a ceramic toilet body and a ceramic toilet tank.

A free-standing toilet of such design with a cast-on toilet tank is frequently also referred to as a "one-piece" toilet. This is a floor-mounted toilet which, after manufacture, comes in one piece and comprises not only the actual toilet body but also the toilet tank, which is inseparably joined to the toilet body.

Free-standing toilets according to prior art comprise a flush or water ring at the top of the toilet body. Said ring is annular and hollow, with water from the toilet tank being usually introduced into it by means of suitable piping, and the water being dispersed within the hollow water ring. The water ring is perforated toward the toilet body or the bowl section, respectively, there being a multiplicity of holes set at a distance from one another through which the water streams from the water ring into the toilet body. This water ring has to be manufactured as a separate component because, due to its shape being that of a hollow body which is merely perforated by means of a few holes, it cannot be cast together with the toilet body. That is to say that free-standing toilets according to prior art consist of three components, namely the actual bowl-shaped toilet body, the water ring and the toilet tank. These three separate components are joined to one another after manufacture. In this context, the water ring needs to be joined to the toilet body by means of adhesive slurry, and the toilet tank also has to be fixed to the rear region of the toilet body by means of adhesive slurry. Thereafter, the thus assembled toilet is glazed and fired.

The manufacture of such a free-standing toilet is, in consequence, very costly, given that three separate components need to be manufactured which subsequently have to be joined in corresponding work steps.

Moreover, the manufacture of such a free-standing toilet is not possible using pressure casting machines. Such machines apply pressure that squeezes the water contained in the casting slurry out through the porous mold walls, usually made of plastic, as opposed to the plaster of paris molds otherwise used, through which the water diffuses during the dwelling time. The complexity of the shape and the design of the water ring, respectively, do not permit manufacture on a pressure casting machine.

The object of the invention is, therefore, to provide a free-standing toilet which is firstly simpler to manufacture and which secondly may be manufactured on a pressure casting machine.

To achieve this object in a free-standing toilet of the aforementioned type, according to the invention, the pressure cast toilet body has an annular flange located on the upper rim of its bowl section, which annular flange continues circumferentially around and extends substantially horizontally toward the inside of the bowl section and serves as a border for the flushing water that is introduced below the annular flange by means of an introduction unit, and the toilet tank, which is also pressure cast, is fixedly joined to the toilet body by means of a ceramic bonding.

It is particularly advantageous that no hollow-body type water ring is provided for introducing or dispersing water in the free-standing toilet according to the invention. Instead, the free-standing toilet according to the invention only comprises an annular flange which continues circumferentially around on the upper rim and which extends inward, in other words, extends horizontally with reference to the installed position of the free-standing toilet, and which, being a simple annular flange, is open on the underside in the direction of the inside of the bowl. This annular flange ultimately serves merely as a splashguard or a flow boundary for the flush water which is introduced below this annular flange. The introduction, and thus ultimately the dispersion of the flush water, is carried out by means of a separate introduction unit, made preferably of plastic, which is inserted beneath the annular flange in the rear region thereof and which is supplied with flush water coming from the toilet tank.

As a result, the free-standing toilet according to the invention consists of only two pieces, namely the toilet body and the toilet tank, which are both ceramic components that may be simply joined to one another by using adhesive slurry. As the toilet tank, being a substantially rectangular hollow component, can be simply manufactured, it may be readily made on a pressure casting machine. The toilet body, too, is of a simple shape since, on the upper edge, there is provided only the inwardly extending flange in the form of a simple, single-walled body portion, as a result of which said toilet body can also be manufactured on a pressure casting machine. This is because it is readily possible to reproduce the shape of this annular flange on a pressure casting machine and thus to pressure cast the entire toilet body.

The free-standing toilet according to the invention offers a range of advantages. For one, it is significantly simpler to manufacture, as only two pieces need to be manufactured which are subsequently joined together by using adhesive slurry. Moreover, both pieces may be made on a pressure casting machine, which allows significantly faster manufacture than is the case with conventional free-standing toilets when using plaster of paris molds. As only a simple annular flange is provided, hygienic advantages are also offered, since cleaning underneath the annular flange, which is, after all, easily accessible, is very simple in comparison with a traditional closed water ring which has only multiple perforations. Finally, the free-standing toilet also has only one joint line, namely in the region where the toilet tank and the toilet body are joined together, as opposed to prior art, where two such joint lines are present.

As described, an introduction unit for introducing flush water has to be installed beneath the annular flange in the rear region of the bowl. In order to conceal said introduction unit from view from the front, a rim flange which is directed toward the bottom of the bowl section is expediently formed on the annular flange in the region close to the toilet tank in order to create an installation space for the introduction unit. This is to say that the annular flange with its free inside end angularly merges with a rim flange which projects by a few centimeters toward the inside of the bowl. Thus this dm flange creates a sight screen that obscures the introduction unit located behind it. The rim flange continues circumferentially around for at least 90°, its specific length depending on the length of the introduction unit which self-evidently also has a partially annular shape which corresponds to the shape of the bowl or the region below the annular flange, enabling it to be located there in a shape-adapted manner.

The introduction unit is a hollow body, preferably made of plastic, on which, preferably on the rear side, there is provided a connection for a flush line which channels water from the toilet tank to the introduction unit. The introduction unit further comprises two front-mounted lateral exit openings from which the flush water streams into the bowl section on both sides. Otherwise, the introduction unit is of closed design, with the exception of the connection for the flush line and the two lateral exit openings, thus allowing flush water to flow in and to stream out into the bowl only in a defined manner, thus allowing an elevated flush water pressure to be achieved while, at the same time, any overflowing is precluded. The exit openings are located laterally, such that the flush water streams in dose to the wall of the bowl. The rim flange is arranged on the annular flange which continues circumferentially around the entire bowl, and is directed toward the bottom of the bowl and continues circumferentially around the bowl only sectionally, at least to the extent that the introduction unit may be installed behind it in an entirely obscured manner. An installation space is created by the rim flange for the introduction unit located behind it.

As the introduction unit needs to be supplied with water, and with the toilet tank being mounted on the toilet body in the rear region, a through hole for accommodating a flush water supply line to the introduction unit is expediently located in the region of the upper rear rim of the bowl section. The configuration may be such that either the introduction unit penetrates this through hole with a connection sleeve, the flush water supply line then being connected to said connection sleeve, or that the flush water supply line is carried through the through hole and connected to the introduction unit at that end.

There are two fundamentally distinct alternatives for the evacuation of waste accumulating in the toilet body. One is by means of the usual siphon which is immediately connected to the bowl, which is usual in particular in the case of toilets installed in Europe. The second alternative for the evacuation is the so-called suction action as used predominantly in Northern America and also Asia. In this method, the actual flush water which flushes the waste directly out of the bowl is introduced locally in the bottom region of the bowl, with the water then streaming into a suction siphon which is joined to a corresponding connection at the bottom of the bowl. The introduced water thus rises in the bowl as well as in the siphon, until reaching a maximum fill height which initiates an automatic suction effect causing the flush water to be evacuated from the siphon and thus also forcibly from the bowl by means of a powerful suction, until the bowl has been emptied almost entirely. To be able to realize this flushing-out capability in the free-standing toilet according to the invention, too, it is expediently provided that a through hole for connecting a flush line is located in the front of the lower region of the bowl section, and a connection is located, as an extension of the breakout, on the opposite rear side of the bowl section for a tortuous suction siphon enabling a suction-driven discharge from the bowl section. The flush water hose may thus be connected at the front side, such that the major part of the flush water (a certain proportion of the flush water is, after all, introduced in the upper region of the bowl via the introduction component) can be introduced in the lower bowl region directly at the transition to the suction siphon.

As described, an inflow of water is provided in the upper bowl region by means of the introduction unit, as well as in the lower bowl region by means, for example in the described respective embodiment, of the suction siphon. In order to implement this in a simple manner with reference to the arrangement of lines, a flush water line leading from the toilet tank is expediently provided which branches out to a line section that leads to the through hole located in the lower region of the bowl and to a line section section that leads to the through hole located in the upper region of the bowl and is connected to the introduction unit. Both line sections are thus commonly supplied. The operation is thus that the flush water firstly supplies the line section leading to the lower bowl connection. When the level of the water streaming rises in the siphon and the bowl respectively, it inevitably also backs up in the flush water line and the line section, respectively. This leads to the water also backing up into the upper line section, and to the flush water that subsequently streams in being channeled via said upper line section into the introduction unit. From there, it is then introduced with adequate pressure quasi tangentially to the bowl rim.

If a suction siphon is provided, this may be either fixedly joined to the toilet body by means of casting-on, that is to say that the suction siphon in the form of a ceramic component is also bonded to the toilet body at a suitable interfacing point by means of adhesive slurry prior to firing and then fired together with the toilet body and the toilet tank to form a complete unit. Alternatively, however, it is also conceivable to manufacture the suction siphon as a separate ceramic component and to fasten it by means of a corresponding adhesive means post-firing, after the free-standing toilet as such and the suction siphon have been fired separately. In principle, an embodiment of the suction siphon made of plastic is self-evidently also conceivable, with this plastic pipe then being fastened to the toilet body by a corresponding connecting means.

The introduction unit is itself preferably also made of plastic as already described, this being a very simple to manufacture hollow plastic injection-molded part.

Apart from the free-standing toilet, the invention further relates to a method for manufacturing a free-standing toilet of the described type. The method is characterized in that, by means of a pressure casting machine, the toilet body, having a bowl section with an annular flange which is located on the upper rim and which continues circumferentially around and extends substantially horizontally toward the inside of the bowl section and which is open on the bottom, is cast in a first press together with a rim flange which is directed toward the bottom of the bowl section and which continues circumferentially around the annular flange only regionally, the toilet tank is cast in a second press, the toilet tank is transferred from the second press to the first press and placed on the toilet body in a region behind the annular flange and fastened to the toilet body by means of an adhesive slurry, and the compound structure consisting of toilet body and toilet tank is glazed and subsequently fired.

The toilet tank is preferably transported from the second to the first press by means of a transport robot, with it self-evidently also being preferable for the adhesive slurry to be applied automatically by means of an application robot. That is to say that the manufacturing process is automated as far as possible.

Furthermore, the possibility exists according to the invention to join a ceramic suction siphon to the toilet body by means of adhesive slurry prior to glazing and firing. This is also carried out preferably in the first press, wherein this suction siphon, too, may be mounted by means of a transport robot and the adhesive slurry may likewise be applied automatically. It is, however, also conceivable that this is carried out manually. Alternatively, the possibility exists to join the then fired suction siphon by adhesive means to the compound structure consisting of toilet body and toilet tank after the latter has been fired.

Figure 2:
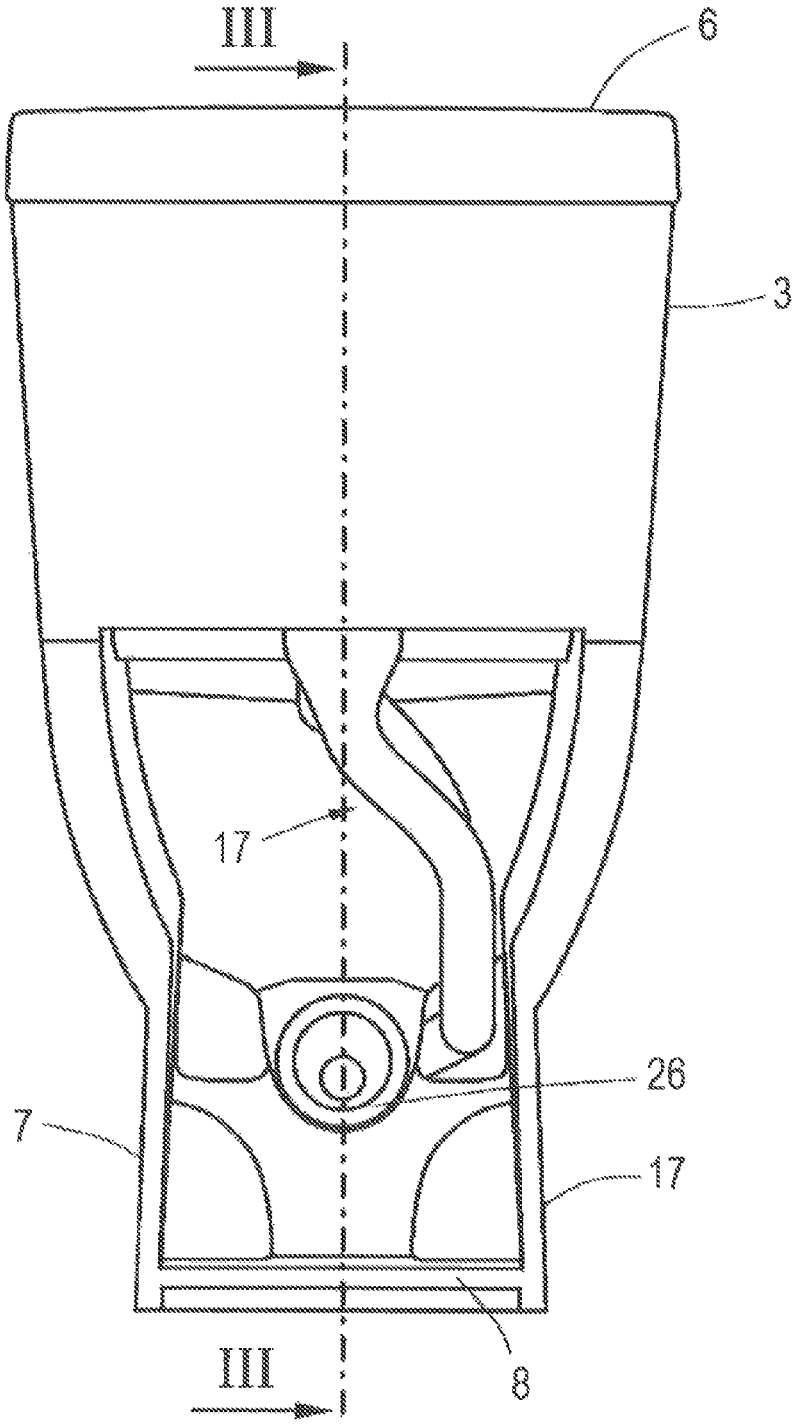
Figure 3:
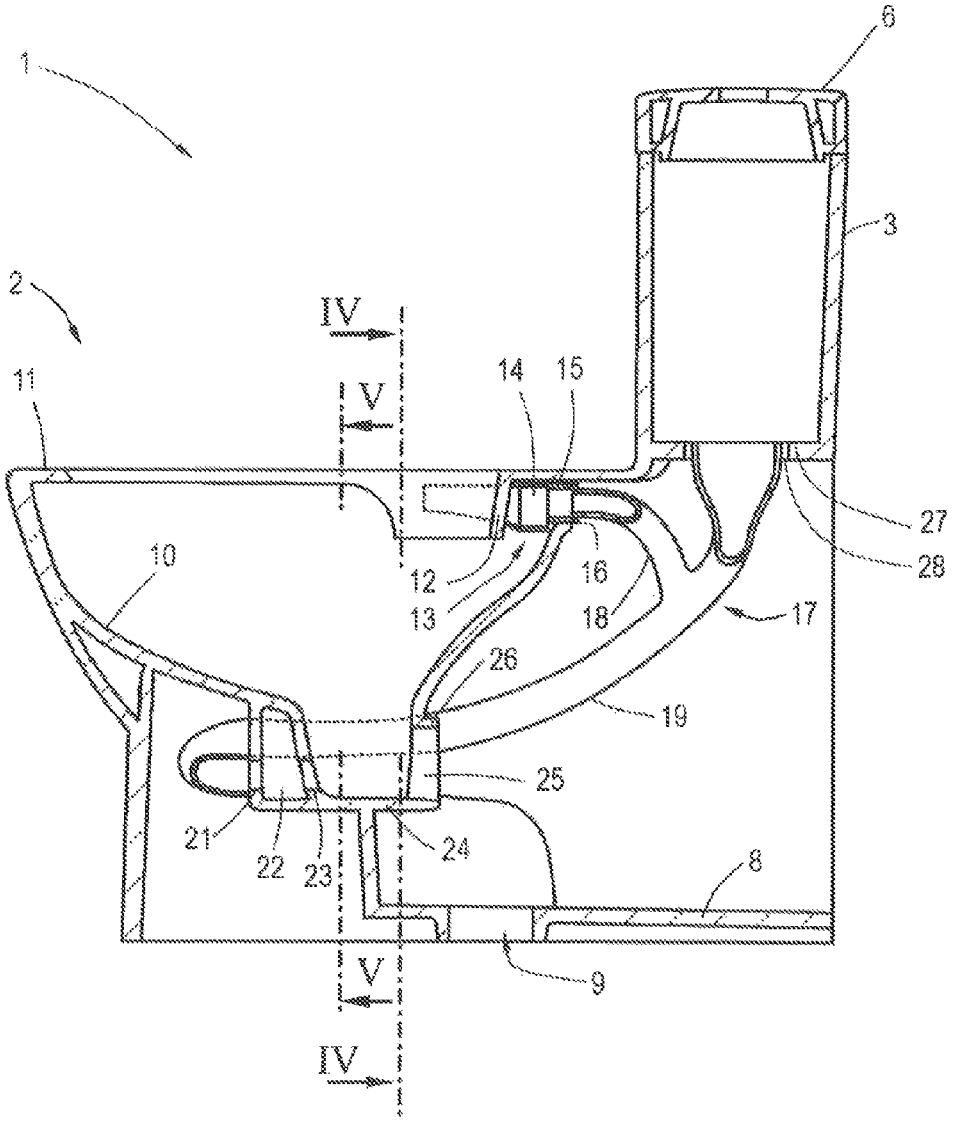
Figure 4:
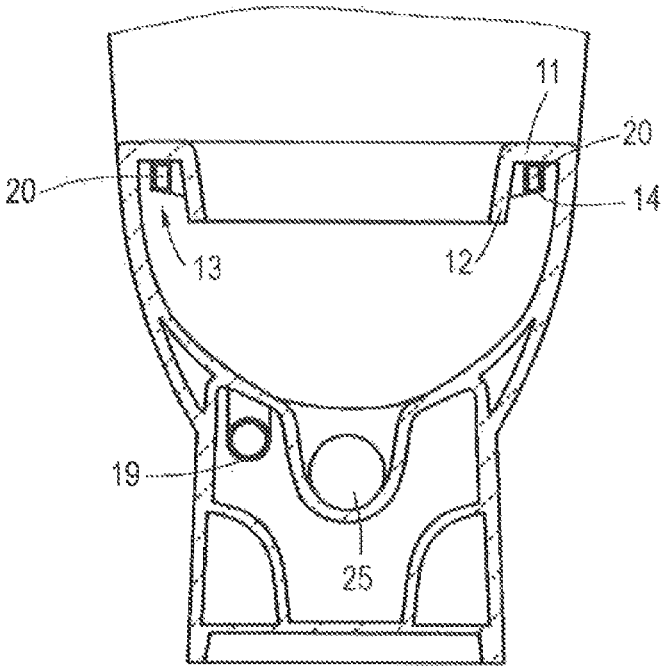
Figure 5:
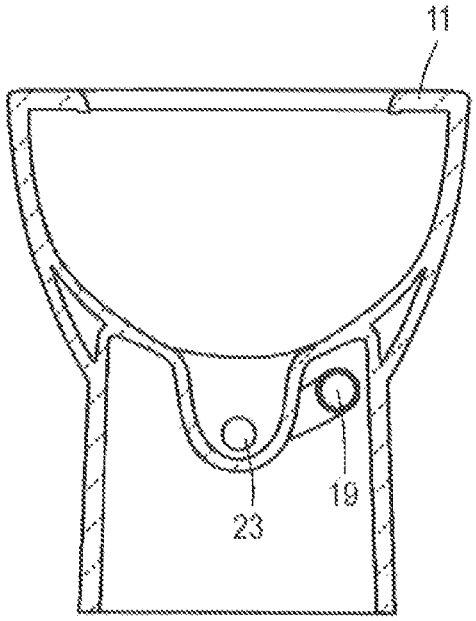
Figure 6:
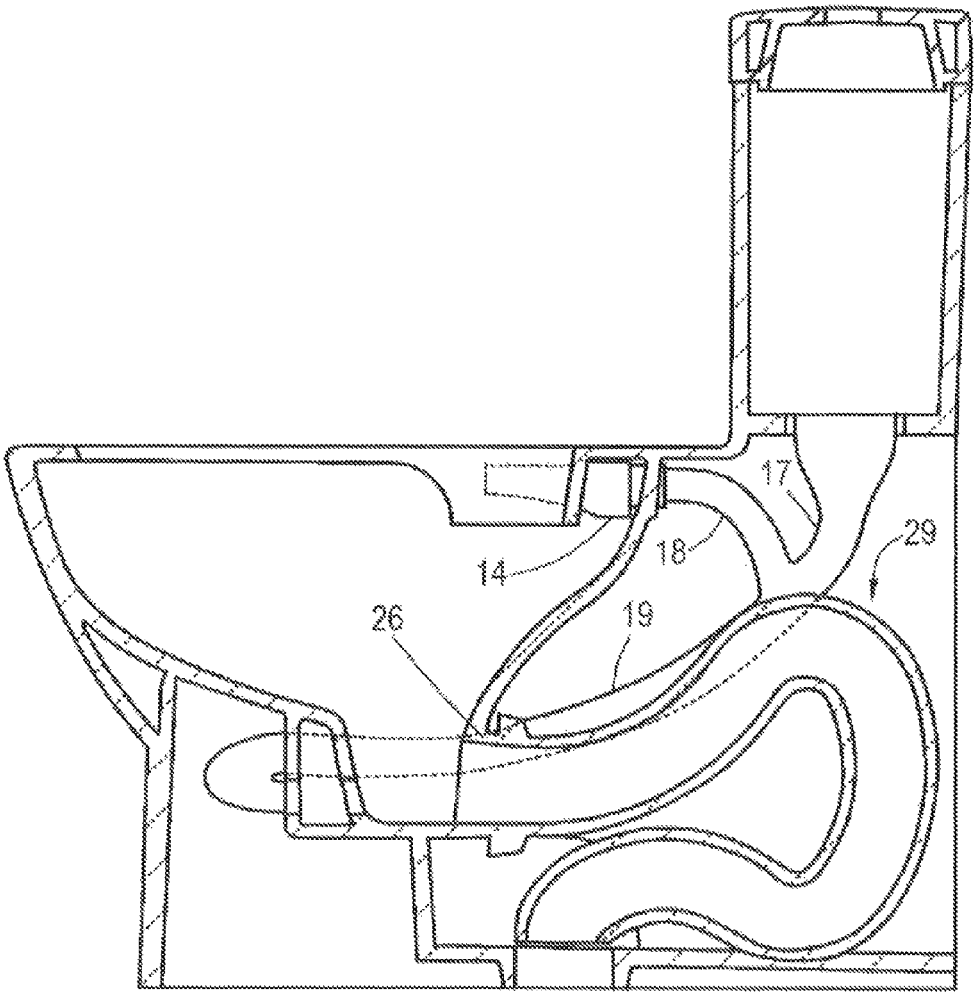

Further advantages, characteristics and details of the invention are explained in the following exemplary embodiment with reference to the figures, wherein FIG. 1 is a side view of a free-standing toilet according to the invention, FIG. 2 is a rear view of the toilet shown in FIG. 1, FIG. 3 is a sectional view along the line III-III shown in FIG. 2, FIG. 4 is a sectional view along the line IV-IV shown in FIG. 3, FIG. 5 is a sectional view along the line V-V shown in FIG. 3, and FIG. 6 is a sectional view corresponding to FIG. 3 with a joined suction siphon.

FIG. 1 shows a free-standing toilet according to the invention, which is embodied as a one-piece ceramic component. It consists of two significant elements, namely firstly the toilet body 2, and secondly the toilet tank 3. Toilet body 2 and toilet tank 3 are separately manufactured ceramic components which are manufactured separately on a pressure casting machine and thereafter fixedly joined to one another by means of adhesive slurry. The joint line 4 is shown as a dashed line, said joint line being the interfacing point where the toilet body and the toilet tank 3 are joined together by means of the adhesive slurry. After glazing and firing of this compound structure, a one-piece overall shape in terms of material is achieved. Obviously, the free-standing toilet 1 is laterally closed, with only a service opening 5, as shown by way of example in FIG. 1, being provided.

FIG. 2 shows a rear view of the free-standing toilet shown in FIG. 1. Besides the toilet tank 3 with its removable cover 6, the two side walls 7, which laterally close off the free-standing toilet toward the floor and serve as support surfaces and which in the frontal region of the toilet merge with one another in a preferably curved manner, are shown, as is a transversely oriented base 8. The base firstly serves the purpose of stability and secondly also comprises a corresponding through hole 9 through which, in the installed position, a waste line passes for connection of the free-standing toilet 1 to the domestic plumbing.

FIG. 3 shows a longitudinal sectional view of the free-standing toilet 1. Besides the toilet tank 3 and cover 6, the design of the toilet body 2 is particularly visible in the cross-sectional view. The toilet body 2 comprises a bowl section 10 which is bordered at the top by an annular flange 11 that continues around circumferentially. This annular flange 11 projects inward by a few centimeters, extending horizontally in the installed position shown in FIG. 3. As stated, it continues circumferentially around the entire bowl section 10, a horizontal annular flange thus being formed.

In the rear region, that is to say in the region adjacent to the toilet tank 3, the annular flange merges with an angular rim flange 12. This rim flange 12 projects by a few centimeters toward the inside of the bowl. In the illustrated example, it continues circumferentially around for more than 90°, as shown in FIGS. 3 and 4. An installation space 13 is formed or bordered, respectively, by means of the annular flange 11 in conjunction with the rim flange 12, in which installation space an introduction unit 14, made preferably of plastic, is located. The shape of this introduction unit 14 is adapted to that of the installation space 13, and is thus also curved. The introduction unit 14 does not extend circumferentially quite as far as the rim flange 12. The introduction unit 14 is a hollow body with a corresponding connecting flange 15 located at the rear which passes through a corresponding through hole 16 in the bowl section 10. To said connecting flange there is connected a flush line 17 which, originating from the toilet tank 3, branches out to a first line section 18 which, in the illustrated example, leads to the introduction unit 14, and to a second line section 19 that leads to a lower bowl section as described in the following.

By means of the line section 18, water is channeled into the introduction unit 14, the water being dispersed therein. The introduction unit 14 is open at its free end, as shown in FIG. 4, the water then streaming in under pressure more or less tangentially to the bowl wall via the exit openings 20. It is thus introduced below or behind, respectively, the annular flange 11 or the rim flange 12, respectively. The annular flange 11 ultimately serves as a splashguard or flow boundary which ensures that the introduced flush water remains only in the bowl section 10 and, after exiting the openings 20, streams into and flushes out the frontal region of the bowl section.

FIG. 5 shows a sectional view which shows the toilet body 2 from the opposite point of view to that used in FIG. 4. Obviously, only the annular flange 11 is provided here, but no rim flange 12.

As mentioned, a second line section 19 is provided, through which most of the flush water is channeled. This line section 19 leads to a through hole 21 in a frontal region of the bowl section, said bowl section converging in its lower region. The bowl section 10 is of double-walled form in this region. The flush water is channeled through the line section 19 to the connection through hole 21 and from there into a cavity 22, from where it passes via a further through hole 23 into the inner region of the bowl, which is significantly converged in the region close to the bowl base 24. A further through hole 25 for the connection of a suction siphon is provided opposite this through hole 23 and thus also the through hole 21. This suction siphon, which is shown in detail in FIG. 6, is joined to a corresponding connection section 26 of the toilet body, and leads to the through hole 9, where it is in turn connected to a waste line not shown here.

The toilet body 2 is obviously embodied such that it can be manufactured on a pressure casting machine. This is in particular valid for the region of the annular flange 11 and rim flange 12. A hollow-body type water ring as used in prior art is specifically not provided here, this making manufacturing on a pressure casting machine possible in the first place. The toilet tank 3 and cover 6 are of a similarly simple geometric design. If the toilet body 2 and the toilet tank 3 are manufactured on respective pressure casting machines, the toilet tank 3 will be transported by a transport robot to the pressure casting press in which the toilet body 2 has been manufactured. The toilet tank 3 comprises no floor, the floor being embodied by means of a wall 27 of the toilet body in which a through hole 28 for the fastening of the flush water line 17 is provided. The toilet tank 3 is then placed onto this wall 27 and fixed to it by means of adhesive slurry. Subsequently, this compound structure is glazed and fired, such that, all in all, a one-piece free-standing toilet 1 is created.

FIG. 6, finally, shows a sectional view corresponding to FIG. 3, with a suction siphon 29 being provided here. This suction siphon 29 is preferably also made of ceramic. It may also be fixed, prior to firing, to the connection section 26 of the toilet body 2 by means of adhesive slurry, the entire compound structure consisting of toilet body 2, toilet tank 3 and suction siphon 29 thereafter being glazed and fired. This produces a free-standing toilet 1 which, as a one-piece element, also comprises the suction siphon 29. It is however also conceivable that the suction siphon is adhesively joined only after having been fired.

As a result of the geometry of the suction siphon 29, a suction effect is produced. The functioning is such that upon flushing, the water streams from the toilet tank 3 into the flush line 17 and from there firstly into the line section 19. The water streams from there into the lower region of the bowl section 10. As more water flows in, the level rises in the suction siphon 29 as well as in the bowl. Once the water has reached a certain fill level, a backlog is created in the line section 19, that is to say that part of the flush water continues to stream in, but part also backs up and thus rises into the line section 18. From there, it passes into the introduction unit 14, from where it is then discharged into the interior of the bowl. As soon as the fill level in the suction siphon 29 and in the bowl section 10 is sufficiently high, the automatic suction-driven discharge is initiated, that is to say that the flush water that has risen is automatically drawn out through the suction siphon 29. A suction effect is produced which evacuates the flush water almost entirely.

Although the FIGS. 1 to 6 show a toilet embodiment with an option for connecting a suction siphon, it is, of course, also conceivable to embody the toilet body 2 in such a way that a usual siphon is already integrated into the toilet body.

The invention claimed is:

1. Free-standing toilet with cast-on toilet tank, comprising:

a ceramic toilet body and a ceramic toilet tank, wherein the toilet body has a toilet bowl with an annular flange located on an upper rim of the bowl, the annular flange continues circumferentially around and extends substantially horizontally toward an inside of the bowl and serves as a border for flushing water that is introduced below the annular flange by means of an introduction unit, the toilet tank, which is also pressure cast, is fixedly joined to the toilet body by means of a ceramic bonding, a rim flange which is directed toward a bottom of the bowl is formed on the annular flange in a region close to the toilet tank and extends only partially around the annular flange in order to create an installation space for the introduction unit, and the introduction unit is a hollow body and is installed in the installation space, the introduction unit has a water inlet at a rear side of the introduction unit and two water outlets at a front side of the introduction unit from which flushing water is introduced below the annular flange and into the bowl, and a first flush water supply line connected at one end to the toilet tank and at another end to the water inlet of the introduction unit.

2. Free-standing toilet according to claim 1, wherein the rim flange continues circumferentially around the annular flange for at least 90°.

3. Free-standing toilet according to claim 1, wherein a first through hole for accommodating the first flush water supply line from the toilet tank to the introduction unit, is located in a rear upper rim of the bowl.

4. Free-standing toilet according to claim 3, wherein the first flush water supply line leading from the toilet tank has a branch to a second flush water supply line that leads to a second through hole located in a front of the lower region of the bowl.

5. Free-standing toilet according to claim 1, wherein a second through hole for connecting a second flush water supply line is located in a front of a lower region of the bowl, and a connection is located, as an extension of the second through hole, on a rear side of the bowl opposite the second through hole for a serpentine suction siphon enabling a suction-driven discharge from the bowl.

6. Free-standing toilet according to claim 5, wherein the ceramic suction siphon is also fixedly joined to the toilet body by means of a ceramic bonding achieved by casting-on or by means of adhesive bonding carried out post-firing.

7. Free-standing toilet according to claim 1, wherein the introduction unit is made of plastic.

* * * * *